US008344650B2

(12) United States Patent
Shen et al.

(10) Patent No.: US 8,344,650 B2
(45) Date of Patent: Jan. 1, 2013

(54) BACKLIGHT DRIVING SYSTEM

(75) Inventors: Li-Ho Shen, Jhongli (TW); Chien-Hung Chen, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 428 days.

(21) Appl. No.: 12/603,660

(22) Filed: Oct. 22, 2009

(65) Prior Publication Data

US 2010/0156306 A1 Jun. 24, 2010

(30) Foreign Application Priority Data

Dec. 24, 2008 (CN) ..... 2008 1 0241851
Feb. 13, 2009 (TW) ..... 98202080 U

(51) Int. Cl.
*H05B 37/02* (2006.01)

(52) U.S. Cl. ..... 315/291; 315/307; 315/308

(58) Field of Classification Search .... 315/169.1–169.4, 315/209 R, 276, 279, 291, 294, 307, 312, 315/313, 320, DIG. 7; 345/42, 77, 102, 204; 363/17, 71, 97, 98, 131–134
See application file for complete search history.

(56) References Cited

U.S. PATENT DOCUMENTS 6,259,615 B1 * 7/2001 Lin ..... 363/98
6,778,415 B2 * 8/2004 Lin ..... 363/71
7,190,128 B2 * 3/2007 Chen et al. ..... 315/312
7,291,991 B2 * 11/2007 Chen ..... 315/307
7,514,882 B2 * 4/2009 Chang et al. ..... 315/291
7,560,879 B2 * 7/2009 Chen ..... 315/308

* cited by examiner

*Primary Examiner* — Jimmy Vu
(74) *Attorney, Agent, or Firm* — Altis Law Group, Inc.

(57) ABSTRACT

A backlight driving system driving a plurality of lamp groups comprises a phase controller, a pulse width module (PWM) controller, a plurality of power stages, a plurality of transformers and a plurality of switch circuits. The phase controller generates a plurality of phase signals. The PWM controller generates PWM signals. The power stages receive and convert direct current (DC) signals from an external power source to alternative current (AC) signals under the control of the PWM signals. The transformers receive and boost up the AC signals from the power stages to drive the lamp groups. The switch circuits alternatively transmit the DC power signals from the external power source and the PWM signals from the PWM controller to the power stages so as to control outputs of the power stages.

5 Claims, 2 Drawing Sheets

BACKLIGHT DRIVING SYSTEM

BACKGROUND

1. Technical Field

Embodiments of the present disclosure relate to backlight driving systems, and particularly to a backlight driving system to drive a plurality of lamp groups.

2. Description of Related Art

In large liquid crystal display (LCD) panels, such as LCD TVs, a plurality of lamps are configured for luminance of the LCD panels. Traditionally, the lamps are divided into a plurality of groups to function alternately, and a plurality of pulse width modulate (PWM) controllers are utilized to control the groups. Thus, a synchronization circuit must be further employed to synchronize phases and frequencies of the PWM controllers.

BRIEF DESCRIPTION OF THE DRAWINGS

Many aspects of the embodiments can be better understood with references to the following drawings, wherein like numerals depict like parts, and wherein.

DETAILED DESCRIPTION

Figure 1:
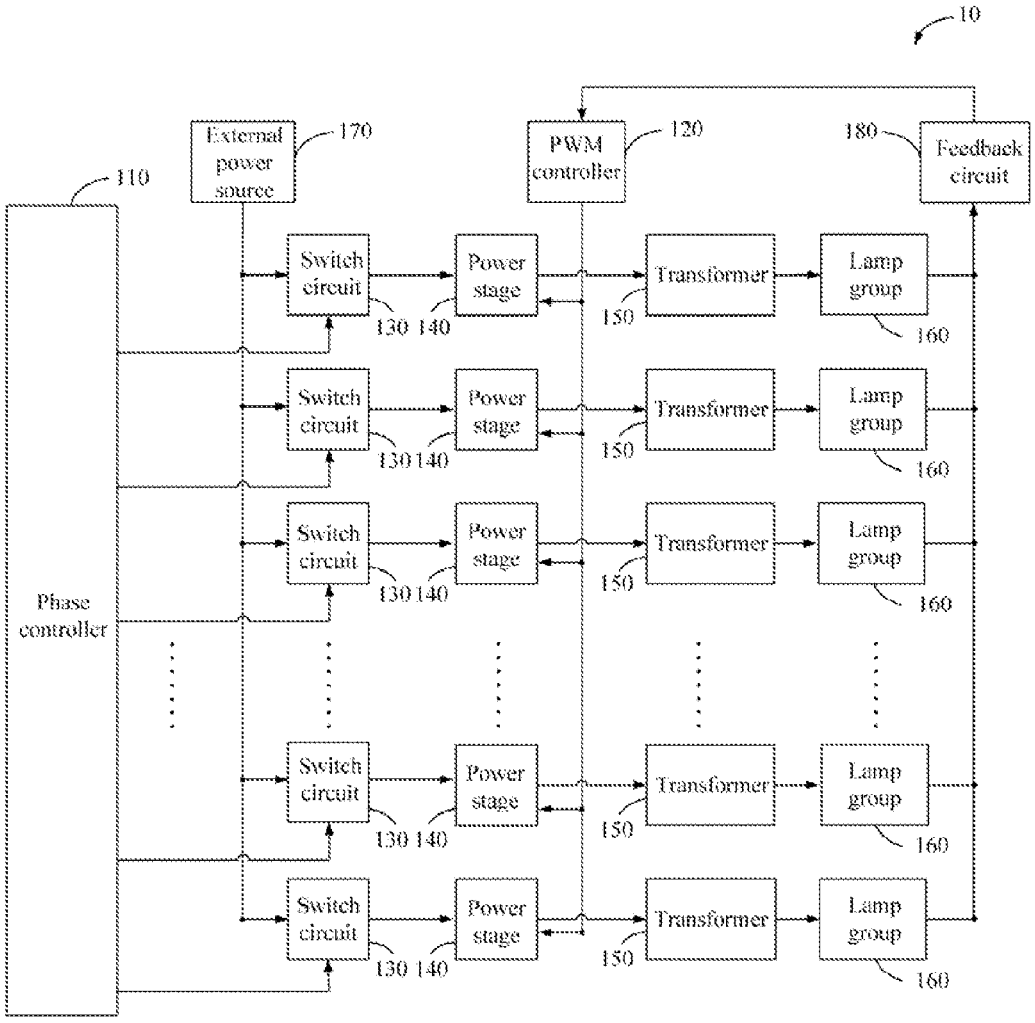
FIG. 1 is a schematic diagram of a backlight driving system of one embodiment of the present disclosure.

Referring to FIG. 1, a schematic diagram of a backlight driving system 10 of one embodiment of the present disclosure is shown. The backlight driving system 10 drives a plurality of lamp groups 160. In one embodiment, the backlight driving system 10 comprises a phase controller 110, a pulse width modulate (PWM) controller 120, a plurality of switch circuits 130, a plurality of power stages 140 and a plurality of transformers 150.

The phase controller 110 generates a plurality of phase signals to the plurality of switch circuits 130, respectively. The phase signals shift between positive and negative phases to correspondingly control transmission of the plurality of switch circuits 130. For example, one of the plurality of switch circuits 130 turns on when a corresponding one of the plurality of phase signals shifts to the positive phase, and off when the corresponding phase signal shifts to the negative phase.

In this embodiment, the plurality of switch circuits 130 are connected between an external power source 170 and the plurality of power stages 140 correspondingly, and are configured to transmit direct current (DC) signals from the external power source 170 to the power stages 140 under control of the plurality of phase signals. In this exemplary embodiment, each of the plurality of switch circuits 130 comprises a first end connected to the external power source 170 to receive the DC signals, a second end connected to one of the plurality of power stages 140 to output the DC signals, and a third end connected to the phase controller 110 to receive one of the plurality of phase signals to control the transmission of the DC signals.

The plurality of power stages 140 convert the DC power signals to alternative current (AC) signals, respectively. In one embodiment, each of the plurality of power stages 140 comprises a inverter circuit. The PWM controller 120 generates PMW signals to the plurality of power stages 140 directly to control conversion of the power stages 140. In one embodiment, the plurality of power stages 140 are under the control of the PWM signals of the same phase and frequency generated by the PWM controller 120. Therefore, no synchronization circuit is required and cost decreases.

The plurality of transformers 150 receive and boost up the AC signals to drive the plurality of lamp groups 160, respectively.

In this embodiment, the backlight driving system 10 further comprises a feedback circuit 180 connected between the PWM controller 120 and the plurality of lamp groups 160. The feedback circuit 180 detects current flowing through the plurality of lamp groups 160, and generates a feedback signal to the PWM controller 120. In this exemplary embodiment, when current variation in the current of the plurality of lamp groups 160 occurs with voltage variation in the DC signals, the feedback circuit 180 detects and feeds back the current variation to the PWM controller 120. The PWM controller 120 controls conversion of the plurality of power stages 140 to stabilize the AC signals according to the feedback signal subsequently.

In this exemplary embodiment, when one of the plurality of phase signals from the phase controller 110 shifts to the positive phase, a corresponding one of the plurality of switch circuits 130 turns on and transmits the DC signals from the external power source 170 to a corresponding one of the plurality of power stages 140. The corresponding one of the plurality of power stages 140 receives and coverts the power signals to the AC signals according to the PWM signal, then a corresponding one of the plurality of transformers 150 receives and boosts up the AC signals to drive a corresponding one of the plurality of lamp groups 160. When the one of the plurality of phase signals shifts to the negative phase, the corresponding one of the plurality of switch circuits 130 turns off, and stops transmitting the DC signals from the external power source 170 to the corresponding one of the plurality of power stage 140, and the corresponding one of the plurality of lamp groups 160 turns off. Thus, the phase controller 110 is operable to control the plurality of lamp groups 160 by controlling the transmission of the DC signals from the external power source 170 to the plurality of power stages 140.

Figure 2:
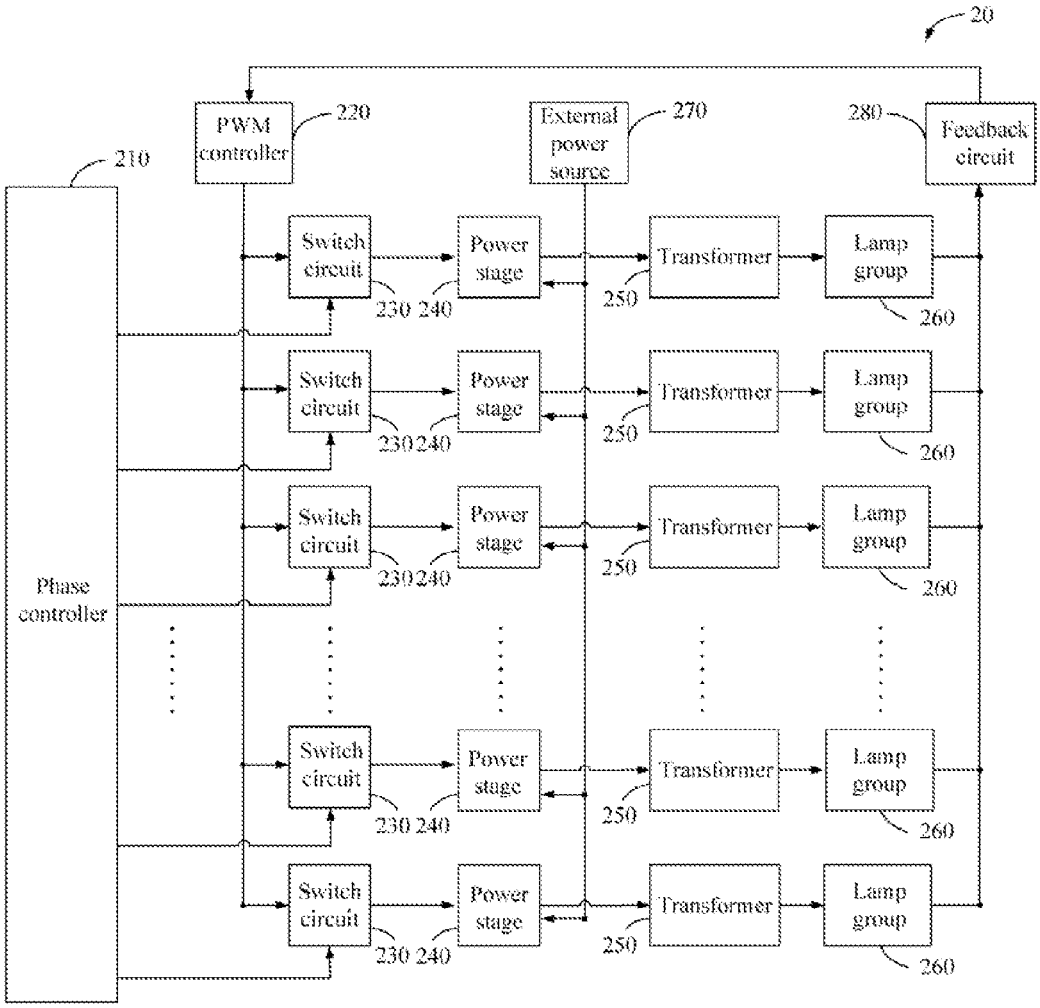
FIG. 2 is a schematic diagram of a backlight driving system of another embodiment of the present disclosure.

Referring to FIG. 2, a schematic diagram of a backlight driving system 20 of another embodiment of the present disclosure is shown. In one embodiment, the backlight driving system 20 comprises a phase controller 210, a pulse width modulate (PWM) controller 220, a plurality of switch circuits 230, a plurality of power stages 240 and a plurality of transformers 250. The plurality of transformers 250 and the plurality of lamp groups 260 shown in FIG. 2 are substantially similar to the plurality of transformers 150 and the plurality of lamp groups 160 shown in FIG. 1, thus descriptions thereof are omitted.

In one embodiment, the phase controller 210 generates a plurality of phase signals to the switch circuits 230, respectively. The plurality of phase signals shift between the positive and negative phases to control transmission of the plurality of switch circuits 230. In one embodiment, one of the plurality of switch circuits 130 turns on when a corresponding one of the plurality of phase signals shifts to the positive phase, and turns off when the corresponding one of the plurality of phase signals shifts to the negative phase.

The plurality of switch circuits 230 are connected between the PWM controller 220 and the plurality of power stages 240 individually, and transmit the PWM signals from the PWM controller 220 to the plurality of power stages 270 under the control of the plurality of phase signals. In one embodiment, each of the plurality of switch circuits 230 comprises a first end connected to the PWM controller 220 to receive the PWM signals, a second end connected to one of the plurality of power stages 240 to output the PWM signals, and a third end connected to the phase controller 210 to receive one of the phase signals to control the transmission of the PWM signals.

The external power source 270 supplies the DC signals to the plurality of power stages 240 directly. The plurality of power stages 240 receive and convert the DC signals from the external power source 270 to the AC signals. The plurality of transformers 250 receive and boost up the AC signals to drive the plurality of lamp groups 260, respectively. In one embodiment, the plurality of power stages 240 are all controlled by the PWM signals of the same phase and frequency generated by the PWM controller 220. Therefore, no synchronization circuit is required and cost decreases.

In one embodiment, the backlight driving system 20 further comprises a feedback circuit 280 connected between the PWM controller 220 and the plurality of lamp groups 260. The feedback circuit 280 detects current flowing through the plurality of lamp groups 260 and generates a feedback signal to the PWM controller 220. In one embodiment, when current variation occurs in the current of the plurality of lamp groups 260 with voltage variation in the DC signals, the feedback circuit 280 detects and feeds back the current variation to the PWM controller 220. The PWM controller 220 controls conversion of the plurality of power stages 240 to stabilize the AC signals according to the feedback signal, subsequently.

In one embodiment, if one of the plurality of the switch circuit 230 turns on when a corresponding one of the plurality of phase signals shifts to the positive phase, a corresponding one of the plurality of switch circuits 230 transmits the PWM signals from the PWM controller 220 to a corresponding one of the plurality of power stages 240, then the corresponding one of the plurality of power stages 240 converts the DC signals to the AC signals according to the PWM signals. The AC signals are received and boosted up by a corresponding one of the plurality of transformers 250 to drive a corresponding one of the plurality of lamp groups 260. If the corresponding one of the plurality of switch circuits 230 turns off when the corresponding one of the plurality of phase signals shifts to the negative phase, the transmission of the PWM signals from the PWM controller 220 to the corresponding one of the plurality of power stages 240 stops, then the corresponding one of the plurality of lamp groups 260 turns off. Thus, the phase controller 210 is operable to control the plurality of lamp groups 260 by controlling the transmission of the PWM signals from the PWM controller 220 to the plurality of power stages 240.

It is apparent that embodiments of the present disclosure provides a backlight driving system operable to control a plurality of lamp groups by controlling transmission of PWM signals from a PWM controller to a plurality of power stages or DC signals from an external power source to the plurality of power stages. As one PWM controller is employed and no synchronization circuit is needed, the cost of the backlight driving system decreases.

It is believed that the present embodiments and their advantages will be understood from the foregoing description, and it will be apparent that various modifications, alternations and changes may be made thereto without departing from the spirit and scope of the present disclosure, the examples hereinbefore described merely being preferred or exemplary embodiments of the present disclosure.

What is claimed is:

1. A backlight driving system to drive a plurality of lamp groups, the backlight driving system comprising:

a phase controller to generate a plurality of phase signals;

a pulse width modulate (PWM) controller to generate PWM signals;

a plurality of power stages to receive direct current (DC) signals from an external power source and convert the DC signals to alternative current (AC) signals according to the PWM signals;

a plurality of transformers to receive and boost up the AC signals to drive the plurality of lamp groups;

a plurality of switch circuits connected between the external power source and the plurality of power stages, to alternatively transmit the DC signals from the external power source and the PWM signals from the PWM controller to the plurality of power stages under the control of the plurality of phase signals, so as to control outputs of the plurality of power stages; and a feedback circuit connected between the PWM controller and the plurality of lamp groups to detect current flowing through the plurality of lamp groups to generate a feedback signal to the PWM controller;

wherein the plurality of phase signals shift between positive and negative phases to correspondingly control the transmission of the plurality of switch circuits, and each of the plurality of switch circuits comprises a first end connected to the external power source to receive the DC signals, a second end connected to corresponding one of the plurality of power stages to output the DC signals, and a third end connected to the phase controller to receive a corresponding one of the plurality of phase signals.

2. The backlight driving system as claimed in claim 1, wherein the PWM controller distributes the PWM signal to the plurality of power stages directly to control conversion of the DC signals to the AC signals.

3. The backlight driving system as claimed in claim 1, wherein the plurality of switch circuits are connected between the PWM controller and the plurality of power stages to transmit the PWM signals to the plurality of power stages under control of the plurality of phase signals.

4. The backlight driving system as claimed in claim 3, wherein each of the plurality of switch circuits comprises a first end connected to the PWM controller to receive the PWM signals, a second end connected to a corresponding one of the plurality of power stages to output the PWM signals, and a third end connected to the phase controller to receive a corresponding one of the plurality of phase signals.

5. The backlight driving system as claimed in claim 4, wherein the plurality of power stages receive the DC signals from the external power source under the control of the PWM signals, respectively.

* * * * *